United States Patent [19]

Parnell

[11] Patent Number: 4,936,229

[45] Date of Patent: Jun. 26, 1990

[54] PALLET AND METHOD OF MAKING SAME

[75] Inventor: Perry E. Parnell, Washington County, Ala.

[73] Assignee: Huskey Manufacturing, Inc., Chickasaw, Ala.

[21] Appl. No.: 357,956

[22] Filed: May 30, 1989

[51] Int. Cl.[5] ..... B65D 19/00

[52] U.S. Cl. ..... 108/51.3; 108/51.1

[58] Field of Search ..... 108/51.3, 52.1, 56.1, 108/51.1; 206/599, 386, 600

[56] References Cited

U.S. PATENT DOCUMENTS

| | | | |
|---|---|---|---|
| 2,700,521 | 1/1955 | Lapham | 108/52.1 |
| 2,709,559 | 5/1955 | Geisler | 108/51.3 |
| 2,908,464 | 10/1959 | Traudt et al. | 108/51.3 |
| 2,925,947 | 2/1960 | Brown | 108/51.3 X |
| 3,131,656 | 5/1964 | Houle | 108/51.3 |
| 3,301,200 | 1/1967 | Landsiedol | 108/56.1 |
| 3,302,593 | 2/1967 | Roberts | 108/51.3 |
| 3,469,542 | 9/1969 | Ahlenius | 108/56.1 |
| 3,709,161 | 1/1973 | Kauffman | 108/51.3 X |
| 3,927,624 | 12/1975 | Hewson | 108/56.1 |
| 4,690,360 | 9/1987 | Looker | 108/51.1 X |
| 4,714,026 | 12/1987 | Yamaguchi et al. | 108/51.1 |

*Primary Examiner*—Jose V. Chen

*Attorney, Agent, or Firm*—Watson, Cole, Grindle & Watson

[57] ABSTRACT

A lightweight, strong, pallet construction is provided by providing a pair of flat sheets of cardboard and a plurality of elongated runners of cardboard which can be deformed by the forks of a fork lift truck. The runners have notches formed in one edge thereof which enable the runners to be locked together in a matrix which is sandwiched between the flat sheets of cardboard. The upper and lower edges of the runners are adhesively connected to the flat surfaces of the two sheets of cardboard so that the two sheets are disposed in substantially parallel relationship to another. A very strong interconnected structure is thereby provided.

5 Claims, 3 Drawing Sheets

PALLET AND METHOD OF MAKING SAME

BACKGROUND OF THE INVENTION

The present invention relates to pallets of the type which support loads thereon and which are adapted to be lifted and transported from one place to another by fork lift trucks.

Pallets have been made for many years completely of wood, and such pallets are ordinarily reused a number of times. Such pallets are disadvantageous in that they are expensive and heavy. Furthermore, personnel handling wooden pallets often receive splinters. Additionally, such wooden pallets are fabricated at plants where special tooling is available, and it is expensive to ship such heavy pallets to the site where they are to be used.

In an effort to overcome the disadvantages of such wooden pallets, lightweight pallets have been developed using various materials. Corrugated paperboard has been employed in such lightweight pallets, but when such materials are used, the pallets have been thrown away after initial use and are not reused. Such pallets are damaged in use because they are not sufficiently strong and rigid in construction to withstand the forces applied thereto without being damaged. Even though such expendable pallets are much cheaper than wooden pallets, the fact that they cannot be reused is an undesirable feature.

Prior art pallets have employed constructions wherein voids or tunnels are provided therein for receiving the forks of a fork lift truck. These voids are usually quite a bit wider than the forks of a lift truck so as to receive the forks without requiring the truck operator to very accurately align the truck forks with such voids. The presence of such voids substantially reduces the overall strength of the pallet.

SUMMARY OF THE INVENTION

The present invention relates to a pallet made entirely of cardboard material. The term "cardboard" as used herein is intended to denote corrugated paperboard or the like. This provides the desired lightweight inexpensive construction. In addition, the structure of the pallet is such that it is sufficiently strong that it can be reused many times, thereby providing a significant advantage over prior art pallets made of similar material which could not be reused.

An extremely strong construction is provided by providing a pair of flat sheets of cardboard and a plurality of elongated runner means of cardboard which can be deformed by the forks of a fork lift truck. The runner means have notches formed in one edge thereof which enable the runner means to be locked together in a matrix which is sandwiched between the the flat sheets of cardboard. The upper and lower edges of the runner means are adhesively connected to the flat surfaces of the two sheets of cardboard so that the two sheets are disposed in substantially parallel relationship to another. A very strong interconnected structure is thereby provided.

An important feature of the invention is the fact that the runner means extend substantially continuously from one side of the sheets to the other side thereof such that the pallet has no voids or tunnels for receiving the forks of a lift truck. Accordingly, the overall strength of the pallet is substantially greater than that of a similar size pallet with voids or tunnels for receiving the forks of fork lift truck.

When it is desired to lift the pallet with a fork lift truck, the forks must penetrate into the pallet between the upper and lower sheets of cardboard. Such penetration may follow two basic patterns. Firstly, the forks may simply punch out holes in the runner means roughly the size of the cross-section of the forks. Secondly, the forks may cause portions of the runner means to tear away and fold back as the forks enter into the pallet. Of course, some combination of these two patterns may occur.

In any event, after the runner means has been deformed by the forks, a substantial portion of the deformed runner means remains in place to maintain maximum strength of the pallet. The present invention thereby provides the minimum amount of void space which receives the forks of a fork lift truck while the remaining portions remain in strong interconnected relation to one another.

A further significant feature of the invention is the fact that the pallet may be shipped to a site where it is to be used in kit form, whereupon the components of the pallet may be readily assembled in a quick and easy manner by unskilled workers and without the necessity of any special tools.

DESCRIPTION OF THE PREFERRED EMBODIMENT

Figure 1:
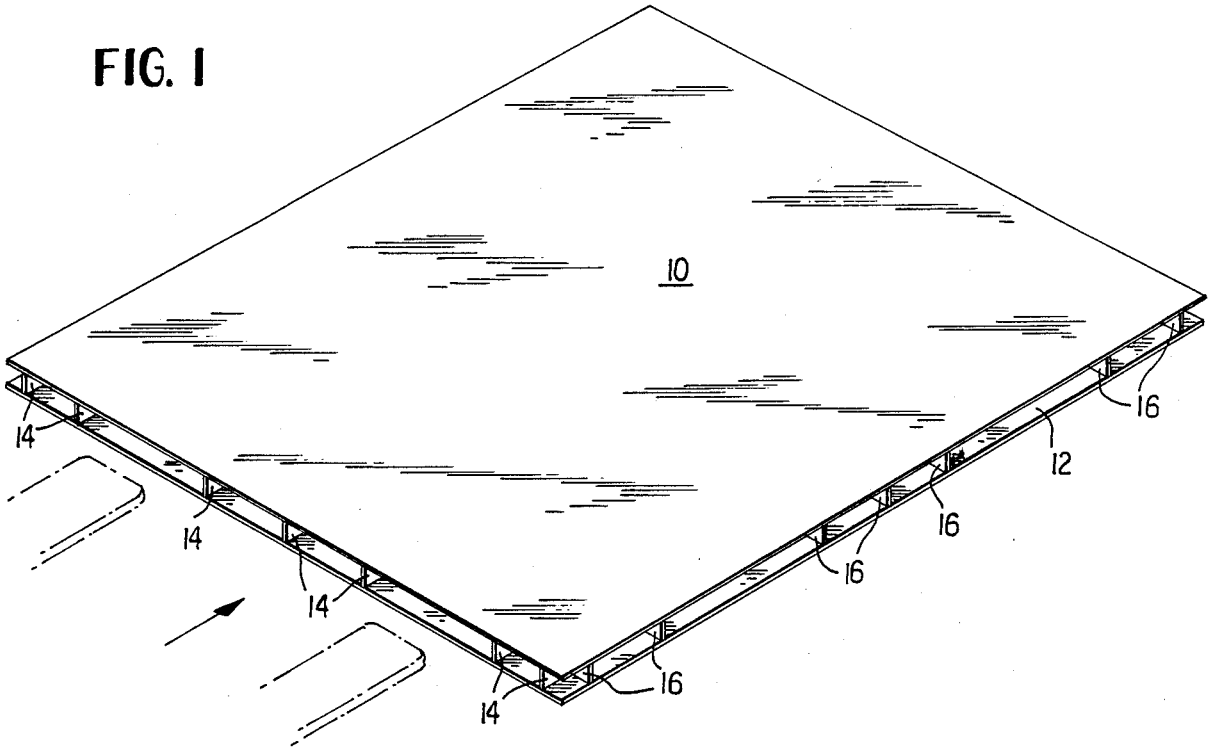
FIG. 1 is a top perspective view of the pallet according to the present invention.

Referring now to the drawings wherein like reference characters designate corresponding parts throughout the several views, there is seen in FIG. 1 a pallet according to the present invention including a pair of similar substantially flat sheets of cardboard material 10 and 12 each of which has a generally rectangular configuration. These two sheets are disposed in substantially parallel relationship to one another and the downwardly facing flat surface of sheet 10 and the upwardly facing flat surface of sheet 12 as seen in FIG. 1 define surfaces facing one another.

A matrix of runner means is sandwiched between the sheets and is formed of cardboard material capable of being deformed by the forks of a fork lift truck. Each of the runner means is of elongated construction having a length extending substantially parallel with the sheets and a width extending substantially perpendicular to the sheets. A first group of runner means 14 are disposed in substantially parallel relationship to one another, and a second group of runner means 16 are disposed in substantially parallel relationship to one another and substantially perpendicular to the first group of runner means 14.

Figure 2:
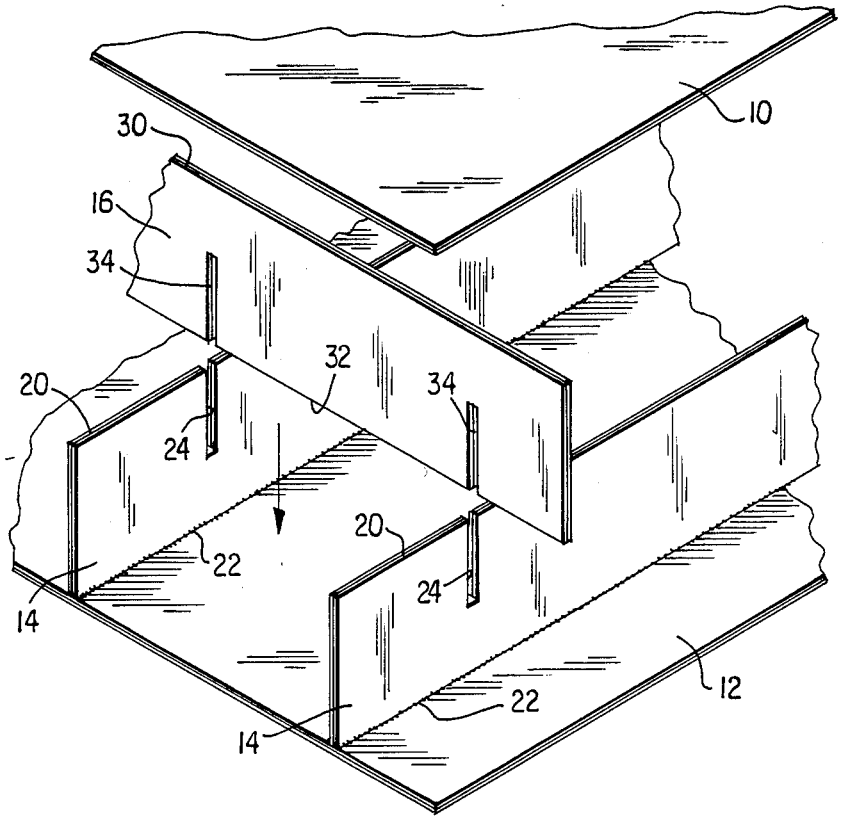
FIG. 2 is a top perspective exploded view on an enlarged scale of a corner portion of the pallet shown in FIG. 1 and illustrating the manner the runner means are locked together.

As seen in FIG. 2, each of runner means 14 has an upper edge 20 and a lower edge 22. Locking means in the form of a plurality of notches 24 are formed in the upper edge 20 of each of runner means 14, these notches extending from edge 20 toward edge 22 a distance equal to at least half the width of the runner means.

Each of runner means 16 has an upper edge 30 and a lower edge 32. Locking means in the form of a plurality of notches 34 are formed in the lower edge of each of runner means 16, these notches extending from edge 30 toward edge 32 a distance equal to at least half the width of the runner means.

Each of the runner means 14 and 16 is formed with notches at every point where the runner means intersect with one another. It should be understood that when the runner means are assembled into the matrix, the open ends of the notches of the runner means are disposed in facing aligned relation as seen in FIG. 2 whereupon the runner means are moved together. This will cause the lower portions of runner means 14 immediately beneath notches 24 to be received in notches 34 of runner means 16, while the upper portions of runner means 16 immediately above notches 34 will be received in notches 24 of runner means 14. This will cause the lower edges 22 and 32 of runner means 14 and 16 respectively to be in a first plane, while the upper edges 20 and 30 of runner means 14 and 16 are disposed in a second plane parallel to said first plane.

The interengagement of portions of the runner means in the notches formed in the runner means provides a locking means whereby the runner means are locked together in a matrix arrangement. This provides a very strong physical interconnection between the runner means.

The lower edges 22 of runner means 14 are adhesively connected to the upwardly facing surface of sheet 12 as seen in FIG. 2, while the upper edges 30 of runner means 16 are adhesively connected to the downwardly facing surface of sheet 10. The adhesive is preferably a nontoxic water based latex adhesive which penetrates into the fibers of the cardboard to provide a very strong interconnection with the runner means, particularly at those points where the runner means intersect one another. The preferred adhesive for use in the invention is available from Southern Chemical Formulators, Inc. of 7860 Zeigler Blvd., Mobile, Ala. 36608 under the designation 50–9.

Figure 3:
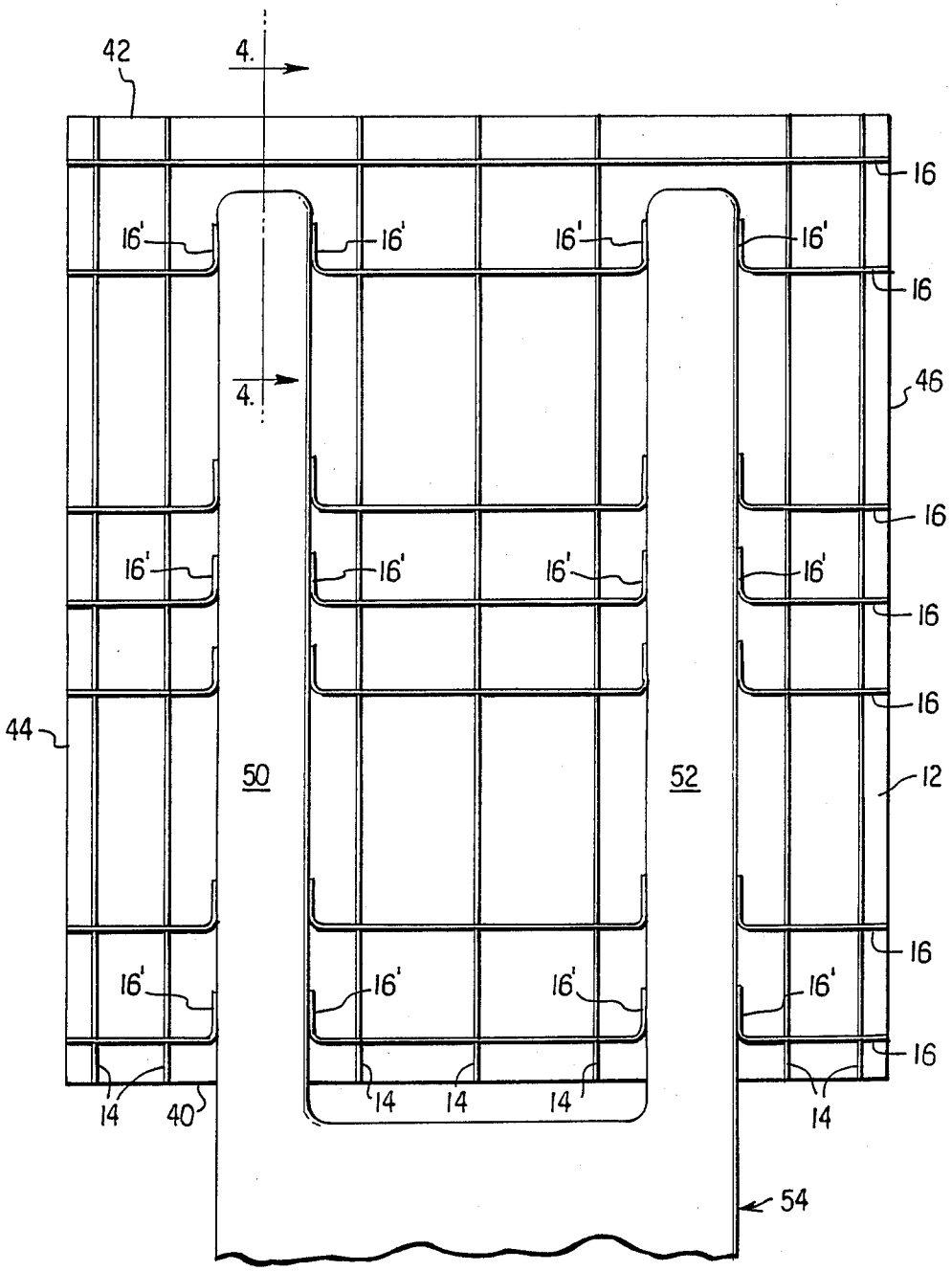
FIG. 3 is a plan view of the pallet shown in FIG. 1 with the top sheet of cardboard removed and showing the forks of a fork lift truck inserted therein.

It is noted that each of the runner means extends substantially continuously along a surface of each of the sheets from one side of the sheets to the other side of the sheets. For example, as seen in FIG. 3, each of runner means 14 extends along sheet 12 from one side 40 thereof to the other side 42 thereof. Each of runner means 16 extends along sheet 12 from one side 44 thereof to the other side 46 thereof. It will be noted that each of runner means 14 spans the space between adjacent pairs of runner means 16, while each of runner means 16 spans the space between adjacent pairs of runner means 14.

As seen in FIG. 3, forks 50 and 52 extend from a fork lift truck indicated generally by reference character 54. Since there are no voids or tunnels to receive the forks, the forks necessarily must deform one or more of the runner means depending on the spacing of the runner means when the forks are inserted between the upper and lower sheets 10 and 12. The spacing may be varied according to the load to be placed on the pallet. As the forks are moved into operative lifting position as shown, they penetrate into the runner means. It should be understood that the forks could also penetrate into the pallet at right angles to the direction shown in FIG. 3.

Figure 5:
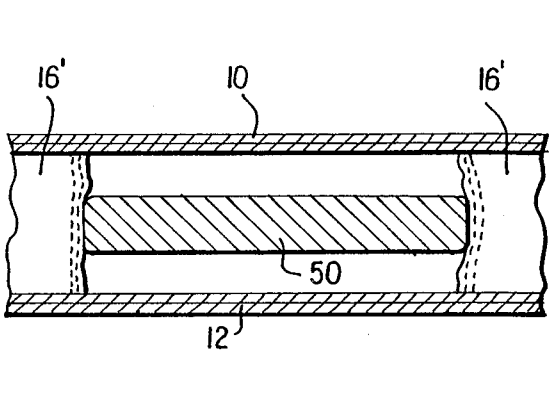
FIG. 5 is a sectional view along line 5—5 of FIG. 4 looking in the direction of the arrows.
Figure 4:
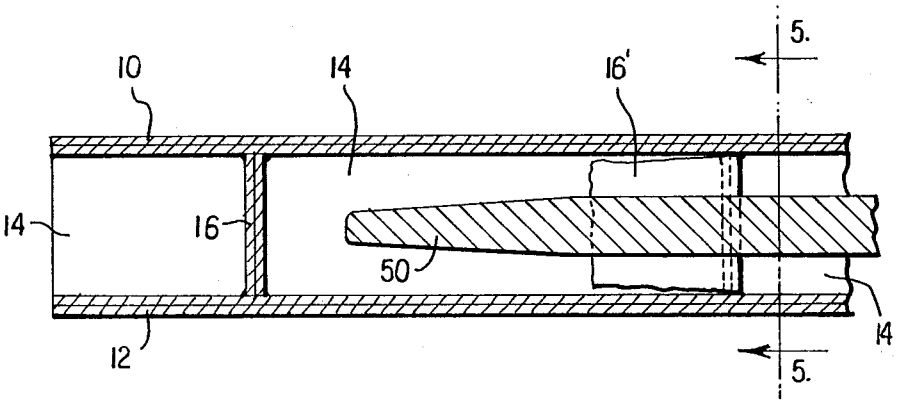
FIG. 4 is a sectional view on an enlarged scale taken along line 4—4 of 3 looking in the direction of the arrows.

As illustrated in FIGS. 3–5, a first basic pattern of penetration is illustrated wherein the forks cause portions of the runner means to tear away and fold back as the forks enter into the pallet. The runner means 16 have torn at approximately the midpoint thereof between adjacent runner means 14 and portions 16' of the runner means have folded back away from the direction of entry of the forks as seen most clearly in FIG. 3. It will be noted that a substantial portion of the deformed runner means 16 between adjacent runner means 14 remains in place to maintain maximum strength of the pallet.

Figure 7:
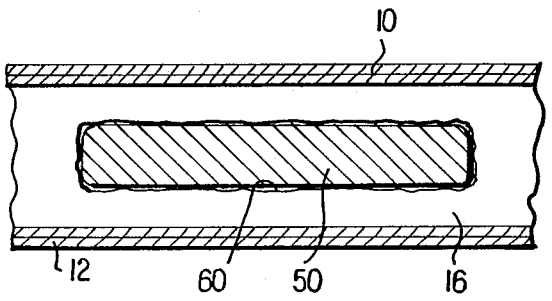
FIG. 7 is a view taken along line 7—7 of FIG. 6 looking in the direction of the arrows.
Figure 6:
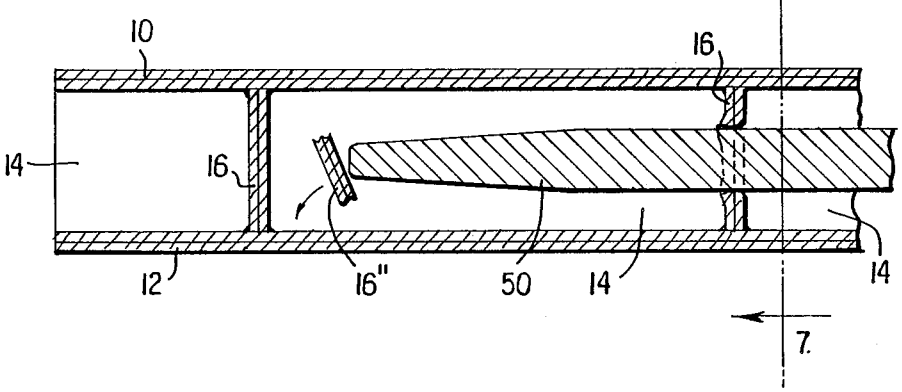
FIG. 6 is a view similar to FIG. 4 showing a different manner in which the penetrate the runner means.

Referring now to FIG. 6 and 7, a second basic pattern of penetration is shown wherein the fork 50 simply punches out a portion 16'' of the runner means 16 to leave a hole 60 roughly the size of the cross-section of the forks. In either pattern of penetration of the forks, a substantial portion of the deformed runner means remains in place thereby providing a minimum amount of void space which receives the forks of a fork lift truck, while the remaining portions remain in strong interconnected relation to one another.

The combination of the locking means forming an interlock between the runner means 14 and 16 along with the adhesive connection of the upper and lower edges of the runner means with the two sheets of cardboard, while not leaving any voids or tunnels for receiving forks provides a very strong and rigid pallet. When the forks enter the pallet as described above, the loss of strength is minimized to provide a pallet which is considerably stronger than a pallet of similar size having voids or tunnels therein for receiving such forks.

The pallet of the invention may be shipped in kit form, and the components may be made into a finished pallet with a minimum of effort using unskilled labor. For example, the runner means may be assembled into the matrix by fitting the runner means into the cooperating notches formed in the edges of the runner means. The lower edges of the matrix may then have adhesive applied thereto, and the matrix set into place on the upwardly facing surface of sheet 12 to adhesively secure sheet 12 to the matrix. The upper edges of the matrix may then have adhesive applied thereto, and sheet 10 may be lowered thereon to adhesively secure the sheet 10 to the matrix which is thereby sandwiched between sheets 10 and 12.

It is apparent that a pallet assembled according to the above example comprises a strong and rigid pallet including first and second groups of runner means extending substantially perpendicular to one another and interlocked together by the cooperating notches. The lower edge of each of the runner means is adhesively connected directly to the upwardly facing surface of sheet 12, and the upper edge of each of the runner means is adhesively connected directly to the downwardly facing surface of sheet 10.

In an alternative method, runner means 14 may be initially adhesively secured to the upwardly facing surface of sheet 12 as shown in FIG. 2, whereupon runner means 16 may be fitted into position relative to runner means 14 to interlock the runner means. The upper edges of the runner means may then be adhesively secured to sheet 10 as described above.

The invention has been described with reference to a preferred embodiment. Obviously, modifications, alterations and other embodiments will occur to others upon reading and understanding this specification. It is my intention to include all such modifications, alterations and alternate embodiments insofar as they come within the scope of the appended claims or the equivalent thereof.

What is claimed is:

1. A substantially rigid cardboard pallet comprising a pair of separate substantially flat uninterrupted sheets of cardboard material having opposite side edges, said sheets being disposed in spaced substantially parallel relationship to one another and defining surfaces facing one another and having a space therebetween of a particular dimension, a matrix of separate runner means sandwiched between said sheets and being formed of cardboard material capable of being deformed by the forks of a fork lift truck, said matrix forming the sole connection between said sheets, each of said runner means being of elongated rectilinear construction and having a length extending substantially parallel with said sheets and a width extending substantially perpendicular to said sheets and having upper and lower edges, said runner means having a substantially constant width throughout the length thereof substantially equal to said dimension, said runner means including a first group of runner means disposed in substantially parallel relationship to one another and a second group of runner means disposed in substantially parallel relationship to one another, said first group of runner means extending substantially perpendicular to said second group of runner means, each of said runner means extending substantially continuously from one side edge of said sheets to an opposite side edge thereof, each of said runner means having the upper edge thereof adhesively connected throughout substantially the entire length thereof directly to the facing surface of one of said sheets and having the lower edge thereof adhesively connected throughout substantially the entire length thereof directly to the facing surface of the other of said sheets, each of the runner means having locking means for locking each of the runner means of one of said groups of runner means to portions of a plurality of runner means of the other of said groups of runner means, said locking means comprising interengaging notches formed in said first and second group of runner means, the runner means of each of said groups of runner means including portions spanning and filling an entire cross-sectional area defined between said sheets and each set of adjacent pairs of runner means of the other of said groups of runner means, said spanning portions of each of said groups of runner means being continuous and uninterrupted between said sheets and between the associated adjacent pair of runner means of the other of said groups of runner means so as to provide no weakened areas thereof and to provide maximum strength throughout the spanning portions, so that the forks of a fork lift truck may enter between said sheets from any side of the pallet, and when the forks enter the space between said sheets, the forks will enter substantially parallel with an adjacent pair of runner means of one of said groups of runner means and will engage at substantially right angles with and necessarily deform a spanning portion of one of the runner means of the other of said group of runner means.

2. A pallet as defined in claim 1 wherein said locking means includes a plurality of notches formed in said first group of runner means for receiving portions of the runner means of said second group of runner means, and a plurality of notches formed in said second group of runner means for receiving portions of the runner means of said first group of runner means.

3. A pallet as defined in claim 2 wherein said notches are formed in the lower edges of the first group of runner means and are formed in the upper edges of the second group of runner means.

4. A pallet as defined in claim 3 wherein each of said notches in said first group of runner means is disposed in aligned adjacent relationship with a notch in said second group of runner means.

5. A pallet as defined in claim 3 wherein said notches extend from the edges of the associated runner means at least half the width of the runner means.

* * * * *